United States Patent [19]

Irvine

[11] Patent Number: 4,555,637

[45] Date of Patent: Nov. 26, 1985

[54] HIGH SPEED TURBOGENERATOR FOR POWER RECOVERY FROM FLUID FLOW WITHIN CONDUIT

[75] Inventor: Michael D. Irvine, La Mirada, Calif.

[73] Assignee: ACD, Inc., Santa Ana, Calif.

[21] Appl. No.: 401,781

[22] Filed: Jul. 26, 1982

[51] Int. Cl.[4] ..... F01D 15/10; H02K 7/18

[52] U.S. Cl. ..... 290/52; 60/715

[58] Field of Search ..... 290/52; 48/61; 60/643, 60/649, 715

[56] References Cited

U.S. PATENT DOCUMENTS

| | | | |
|---|---|---|---|
| 4,125,780 | 11/1978 | Greene | 290/52 X |
| 4,128,769 | 12/1978 | Bons et al. | 290/52 |
| 4,134,024 | 1/1979 | Wiseman | 290/52 |
| 4,155,022 | 5/1979 | Crockett | 290/52 X |
| 4,185,465 | 1/1980 | Shaw | 290/52 X |
| 4,186,311 | 1/1980 | Humiston | 290/52 X |
| 4,208,592 | 6/1980 | Leibow et al. | 290/52 |
| 4,211,932 | 7/1980 | Geary, Jr. | 290/52 |
| 4,219,738 | 8/1980 | Griesinger | 290/52 X |
| 4,229,660 | 11/1980 | Adler | 290/52 X |
| 4,246,490 | 1/1981 | Keramati et al. | 290/52 X |
| 4,253,031 | 2/1981 | Frister | 290/52 |
| 4,276,482 | 6/1981 | Crockett | 290/52 |
| 4,301,375 | 11/1981 | Anderson | 290/52 X |
| 4,302,683 | 11/1981 | Burton | 290/52 X |
| 4,305,129 | 12/1981 | Yannone et al. | 290/52 X |
| 4,352,024 | 9/1982 | Geary et al. | 290/52 |
| 4,359,871 | 11/1982 | Strass | 290/52 X |
| 4,362,020 | 12/1982 | Meacher et al. | 290/52 X |
| 4,367,413 | 1/1983 | Nair | 290/52 |
| 4,392,063 | 7/1983 | Lindquist | 290/52 X |
| 4,394,582 | 7/1983 | Kreissel et al. | 290/52 X |
| 4,395,198 | 7/1983 | Schucker | 290/52 X |

*Primary Examiner*—J. V. Truhe
*Assistant Examiner*—Terry Flower

[57] ABSTRACT

A high speed turbogenerator functionally combining, in one machine, an electrical generator and an expansion turbine. The electrical generator itself has a shaft supported on two bearings and the expansion turbine comprises an expander wheel overhung on the generator shaft and which rotates as a high pressure gas is let down in the expansion turbine to a lower pressure at a minimum predetermined flow rate and pressure drop. The shaft operates at speeds of about 6,000 rpm to 32,000 rpm, preferably at the higher end of such range, i.e. 20,000 to 24,000 rpm. The unit is sufficiently compact that a new use for the electrical generator is to modify the same such that the entire high speed turbogenerator is contained within the conduit carrying the gas to be let down in pressure and only electrical wires need be led through the conduit. The integrity of the conduit is thus retained to the extent possible and only a high pressure cable fitting extends through the conduit. In the preferred embodiment, the high speed turbogenerator is entirely fitted within a natural gas conduit in a gas distribution station, thereby achieving the pressure letdown and also obtaining useful electrical power.

9 Claims, 2 Drawing Figures

HIGH SPEED TURBOGENERATOR FOR POWER RECOVERY FROM FLUID FLOW WITHIN CONDUIT

BACKGROUND OF THE INVENTION

The invention relates to the field of turbogenerators, and more particularly to an improved high speed turbogenerator that is constructed with an electrical generator normally employed in aerospace applications by adding to that generator, an expander wheel of a particular configuration and in which the entire high speed turbogenerator is contained within a conduit having a venturi or restriction in the conduit such that gas flowing through the conduit is directed through the radial inflow expander to turn the same for operating the electrical generator to derive power.

There have been numerous attempts in the past to adapt an electrical generator to be fitted within a conduit carrying a fluid, the objective being to derive energy from the fluid as it passes through the conduit and to thus convert that energy into a useful form.

One of the difficulties, however, is that the integrity of the conduit itself must, of necessity, be breached in order to convey that energy in some form outside the conduit. Various rotameters have been used inside conduits and geared to electrical generators outside the conduit, or other means have included inserting an electrical rotor within the conduit with a station or other excitation means outside the conduit and surrounding the same.

The disadvantages of the former means is obvious from the integrity standpoint of the conduit, i.e., larger openings must be cut into the wall of the conduit and thus special seals must be developed and utilized to prevent the fluid within the conduit from leaking to the outside environment. This is particularly a problem where that fluid is a combustible product such as natural gas.

The latter solution does alleviate the integrity problem but the efficiency of interposing a conduit wall between the rotary part of the generator and the starter causes a great reduction in efficiency of the the overall electrical generation capabilities.

SUMMARY OF THE INVENTION

The present invention combines, in unique fashion, a known electrical generator presently used in the aerospace field with an expansion turbine having an expander wheel of a particular configuration to evolve a high speed turbogenerator that is relatively compact and has certain desirable characteristics. As described hereinafter, the new turbogenerator is a new machine even though it may be described as having two separate functions, that is, the function of an expansion turbine and an electrical generator. Even though such functions may be separately described, however, the novel combined machine is a unitary, turbogenerator, the two separate functions having been married together in a complete and inseparable union.

In particular, the new machine is created by evolving a new use of the aerospace electrical generator combined with an expansion turbine such that the high speed turbogenerator itself has significant advantages for power generation in applications within conduits heretofore not possible. The electrical generator is modified for industrial use and merged into the turbogenerator by combining, on the same shaft as the rotor of the electrical generator, an expander wheel. In this manner, no gearbox is required inasmuch as a new machine is created rather than merely the coupling of two known rotating machines. In the new high speed turbogenerator no additional bearings are utilized, only those bearings normally present in a conventional generator are needed. By matching the speed characteristics of the expander wheel portion of the expansion turbine to the high speed requirements of the aerospace electrical generator, the use of intermediate gearing or gearboxes is eliminated, thus the inefficiencies are avoided as well as the rather cumbersome lubrication systems associated with such gearboxes.

With the new high speed turbogenerator, therefore, various new in conduit applications become possible, due to its compactness. One of such applications is in locating the entire high speed turbogenerator within a conduit carrying high pressure natural gas. The turbogenerator needs no outside mechanical connections by means of gears, shafts, belts or the like and the conduit itself therefore retains, to the extent possible, its integrity, a particularly important feature when dealing with a combustible fluid within the conduit.

There are, therefore, considerable commercial applications present today where a high pressure gas, such as natural gas enters a distribution station at as high as 1500 p.s.i. and is let down to a lower pressure for further distribution. By inserting the present high speed turbogenerator completely within the natural gas conduit, the letdown in pressure in that conduit can still be achieved yet electrical power generation is also obtained and can obviously be utilized for any purpose. Only the electrical cable need breach the integrity of the conduit wall, all of the rotating equipment being completely contained therein. As an example, a typical natural gas letdown station may have a conduit of about 32 in. diameter, which is sufficient space to house a 150 kva high speed turbogenerator within that conduit.

DETAILED DESCRIPTION OF THE INVENTION

Figure 1:
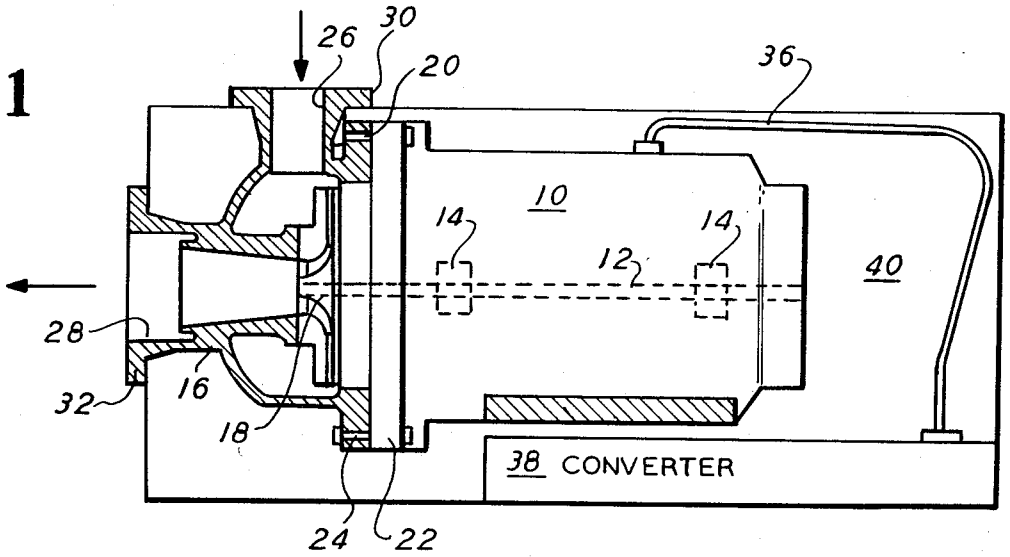
FIG. 1 is a side cross-sectional view of a basic turbogenerator machine on which the present invention is founded.

In FIG. 1, there is shown a side view, partly in cross-section, of a high speed turbogenerator constructed in accordance with the present invention and in which an electrical generator 10 is of a generally available aerospace design. At the present, there are commercially available electrical generators of the type VSCF or variable speed constant frequency generators in various ratings, ranging from about 20 kva to as high as 1000 kva. This type electrical generators are presently utilized exclusively in various aircraft and are described in detail in Technical Report AFAPL-TR-76-8 by the Air Force Aero-Propulsion Laboratory of Wright Patterson Air Force Base entitled "150 kva Samarium Cobalt VSCF Starter Generator Electrical System Phase I", available from the NTIS and dated March 1976.

To date the use of VSCF generators has been limited to the aerospace industry and such electrical generators are characteristically high speed, i.e. 3,000 r.p.m. to about 25,000 r.p.m. Presently, VSCF electrical generator systems are commercially available from General Electric, Aircraft Division and The Bendix Company, Power Division.

A main shaft 12 of electrical generator 10 carries the usual generator rotor (not shown) and is supported by a pair of bearings 14 within electrical generator 10 in conventional manner.

The turbogenerator also includes an expansion turbine 16, however, as previously noted, expansion turbine 16 is not a separate machine but does perform a separate function. Expansion turbine 16 includes a radial inflow expander wheel 18 which is overhung from the extended end of main shaft 12 and is directly affixed thereupon. Expansion turbine 16 has a main flange 20 that is connected directly to a mating flange 22 of the electrical generator 10 by means such as bolts 24. The expansion turbine 16, as described with respect to FIG. 1, provides an inlet 26 and an outlet 28, both of which have flanges 30 and 32, respectively.

As shown, therefore, in the basic high speed turbogenerator of FIG. 1, the high pressure fluid enters the inlet 26 of the expansion turbine 16 and passes through radial inflow expander wheel 18 to exhaust through the outlet 28. By design of radial inflow expander wheel 18, the speed of the radial inflow expander wheel 18 and thus main shaft 12 that operates the electrical generator 10 is established to be from 3,000 r.p.m. to about 32,000 r.p.m. with optimum speeds of about 8,000 r.p.m. to 25,000 r.p.m., which is within the high speed normal operational range of electrical generator 10, given a minimum pressure drop and flow conditions. The pressure drop through the radial inflow expander wheel 18 must be at least about 40 p.s.i. and a minimum flow of about one million scf/day to obtain the needed power for operation of electrical generator 10.

Electrical power generated by electrical generator 10 is transmitted by suitable wiring 36 to a convertor 38 and a transformer 40 to convert the voltage and frequency from electrical generator 10 to more conventional voltage and frequencies.

Figure 2:
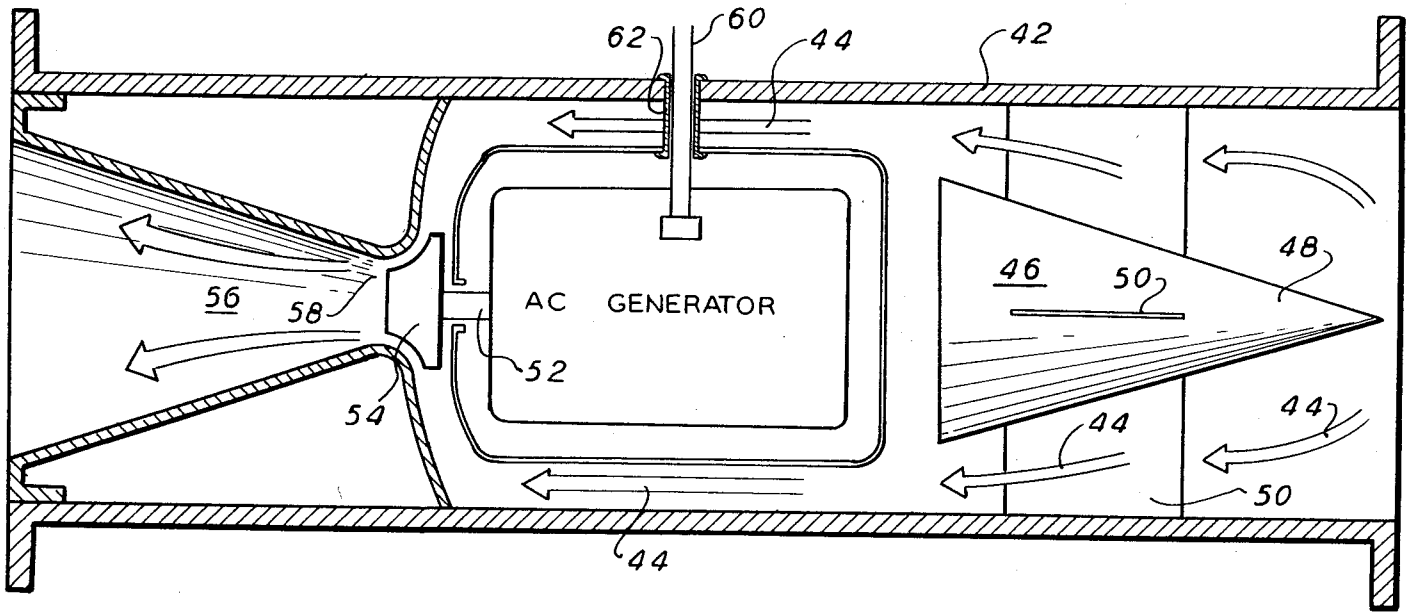
FIG. 2 is a side cross-sectional view of a high speed turbogenerator of FIG. 1, but modified such as to be contained within a conduit carrying a fluid.

Turning now to FIG. 2, there is shown an artist's rendering of a cross-section of a high speed turbogenerator modified with respect to that shown in FIG. 1 to adapt it to a new use within a conduit 42 in which a fluid is flowing.

The conduit 42 carries a high pressure fluid that becomes let down in pressure during its passage through the high speed turbogenerator. Due to the particular characteristics of the turbogenerator, a unit capable of generating about 150 kva can easily be fit within conduit 42 having an internal diameter of about 32 inches.

In FIG. 2 there is assumed a flow of fluid in the direction of arrows 44, therefore, the fluid becomes reduced in pressure as it travels in that direction.

A stabilizer 46 is used to take out, or at least significantly reduce, the swirls in the fluid and may comprise a cone shaped section 48 having a plurality of fins 50 that hold the cone shaped section 48 firmly in position within conduit 42 by having the outer ends of the fins 50 secured in some manner to the internal surface of conduit 42.

The main shaft 52 of the high speed turbogenerator has affixed thereto the expander blade 54 in the same manner as described with respect to FIG. 1.

Downstream of the high speed turbogenerator there is a restriction forming a venturi 56 within conduit 42 and which has a venturi throat 58 through which the fluid stream is directed and concentrated for rotating the expander wheel 54 by locating the expander wheel 54 in close proximity to the venturi throat 58. As the fluid passes through the expander wheel 54 and through venturi throat 58, its pressure is reduced and that energy recovered in the rotational movement of expander wheel 54 which drives main shaft 52 to produce electricity in the high speed turbogenerator. The venturi 56 thereafter increases in diameter until it again reaches the internal diameter of conduit 42 so that the fluid continues downstream to its further use.

The electrical energy generated by the high speed turbogenerator is transmitted by means of wires 60 through a high pressure cable connector 62 for utilization outside conduit 42 and which prevents the escape of fluid from conduit 42 to the outside environment.

As an actual example of the use of a high speed turbogenerator used in a conduit containing a fluid, natural gas lines normally contain natural gas at a pressure of up to 1,500 p.s.i. as the gas approaches a distribution station where the pressure is let down by a valve to a lower pressure for further distribution. In such a distribution station, a pressure drop of in excess of 40 p.s.i. is quite normal and the conduit internal diameter for such stations are approximately 32 inches. In such conduit, a high speed turbogenerator as herein described of a rating at least 150 kva can readily be fitted entirely within the conduit such that only the electrical wires need pass through the conduit through sealed openings, thus the integrity of the conduit can be maintained even in the presence of combustible gas such as natural gas.

I claim:

1. A power recovery system for obtaining electrical power from a flowing fluid, said system comprising:

a conduit through which a fluid passes of a predetermined minimum flow and pressure;

a restriction means in said conduit forming a flow path of reduced area for the fluid, a high speed turbogenerator comprising an electrical generator, said electrical generator having a rotating shaft and a pair of bearings, said shaft having one end thereof extending outwardly from one of said bearings, and a radial inflow expander wheel directly affixed to the extended end of said shaft, said high speed turbogenerator positioned entirely within said conduit and having said expander wheel adjacent said restriction means such that fluid passing through said restriction means causes rotation of said expander wheel at a speed of about 6,000 rpm to about 32,000 rpm and with a reduction in pressure, means to pass electrical wiring carrying current from said high speed turbogenerator through said conduit to a utilization means external of said conduit.

2. A power recovery system as defined in claim 1 wherein said restriction means comprises means to form a venturi within said conduit and said expander wheel is centrally located adjacent the throat of said venturi.

3. A power recovery system as defined in claim 2 wherein said system further includes a stabilizer means located in said conduit upstream of said expander wheel to reduce swirls in the fluid.

4. A power recovery system as defined in claim 2 wherein said fluid is natural gas.

5. A power recovery system as defined in claim 2 wherein said pressure reduction of said fluid through said expander wheel is at least 40 psi.

6. A method of producing electricity from the flow of fluid through a conduit comprising the steps of:

locating entirely within the conduit an electrical generator having affixed to its main shaft a radial inflow expander wheel, directing the flow of fluid through the radial inflow expander wheel to rotate the same, transmitting the power generated by the electrical generator through the conduit for outside utilization.

7. A method of producing electricity as defined in claim 6 wherein said step of directing the flow of fluid comprises directing the fluid though a venturi within the conduit adjacent the radial inflow expander wheel.

8. A method of producing electricity as defined in claim 6 wherein said step of directing the flow of fluid further includes stabilizing the fluid upstream of the expander wheel to eliminate swirls in the fluid.

9. A method of producing electricity as defined in claim 7 wherein said step of directing the flow of fluid causes said radial inflow expander to rotate at a speed of from about 6,000 rpm to about 32,000 rpm.

* * * * *